United States Patent [19]

Webb

[11] Patent Number: 4,570,538

[45] Date of Patent: Feb. 18, 1986

[54] PRESS DAMPENING SYSTEM

[75] Inventor: Claymon D. Webb, Dwight, Ill.

[73] Assignee: R. R. Donnelley & Sons Company, Chicago, Ill.

[21] Appl. No.: 505,221

[22] Filed: Jun. 17, 1983

[51] Int. Cl.[4] ..... B41F 7/30; B41L 25/12

[52] U.S. Cl. ..... 101/148; 101/366

[58] Field of Search ..... 101/147, 148, 366, 350, 101/364, 208, 210; 137/255, 256, 263, 266; 118/302, 300

[56] References Cited

U.S. PATENT DOCUMENTS

| | | | |
|---|---|---|---|
| 2,501,661 | 3/1950 | Christensen | 137/263 |
| 2,969,803 | 1/1961 | Mosher | 137/263 X |
| 3,348,774 | 10/1967 | Wiggins | 118/302 |
| 3,450,092 | 6/1969 | Kock | 118/302 |
| 3,805,821 | 4/1974 | Bitner | 137/263 X |
| 3,949,668 | 4/1976 | Smith, Jr. . | |
| 3,992,992 | 11/1976 | Smith . | |
| 4,050,378 | 9/1977 | Smith, Jr. . | |
| 4,064,801 | 12/1977 | Switall . | |
| 4,151,796 | 5/1979 | Uhrig . | |
| 4,289,167 | 9/1981 | Switall . | |

FOREIGN PATENT DOCUMENTS

| | | | |
|---|---|---|---|
| 1503151 | 3/1978 | United Kingdom | 101/366 |

*Primary Examiner*—J. Reed Fisher

*Attorney, Agent, or Firm*—Wood, Dalton, Phillips, Mason & Rowe

[57] ABSTRACT

A system for supplying dampening fluid to a rotating cylinder of a printing press which includes first and second closed tanks containing the dampening fluid. To move the dampening fluid from one of the first or second tanks compressed air a control pressure proportional to the speed of the press pressurizes one of the tanks. The control pressure in turn causes the dampening fluid to move from one of the tanks through the interconnecting piping to be sprayed onto the cylinder at a flow rate proportional to the speed of the press. To transfer the control pressure from the first to the second tank and provide a constant supply of dampening fluid at the flow rate proportional to the speed of the cylinder means to transfer between the first and second tanks are provided. The transferring means includes providing a quantity of compressed air at the control pressure through a restriction to the nonsupplying tank for a period of time to pressurize the nonsupplying tank to the control pressure. At the expiration of the period of time necessary to pressurize the tank, the control pressure is transferred from the tank previously supplying dampening fluid to the now pressurized tank to supply dampening fluid to the cylinder. The gradual pressurization of the tank does not significantly affect the control pressure or the resulting flow of dampening fluid.

17 Claims, 3 Drawing Figures

PRESS DAMPENING SYSTEM

BACKGROUND OF THE INVENTION

1. Field of the Invention

This invention relates to printing presses and more particularly to systems for applying dampening fluid to a rotating cylinder of a printing press.

2. Description of the Prior Art

In the offset printing process, a small amount of dampening solution, i.e., water with certain additives, is supplied to the offset plate, which then comes in contact with the inking rollers, the ink adhering to the image on the plate and the dampening solution adhering to the other portions of the plate. The quantity of dampening solution applied must be varied particularly in relation to the press speed. Control of the application of the dampening fluid is particularly important in four-color process, where variations will effect color. If too little fluid is applied, printing will occur in areas where none is desired.

Various systems for dampening the plate cylinder of an offset printing apparatus are in use today. One such system is described in Switall U.S. Pat. No. 4,064,801. This dampening system has a plurality of nozzles to spray dampening fluid on the plate cylinder. To supply dampening fluid through the nozzles, the system includes a tank and an air pump to pressurize the tank. In pressurizing the tank, the dampening fluid is caused to flow therefrom through a pressure compensator which controls the pressure of the dampening fluid according to the speed of the press. Speed of the press is determined by a tachometer which, through appropriate means, controls the adjustment of the pressure compensator.

One of the drawbacks of prior dampening systems is that continuous operation of the printing press requires a constant supply of dampening fluid at the correct pressure as determined by, for example, the speed of the press. Providing a very large tank puts demands upon the space requirements for the dampening system. Furthermore, pressurizing the large tank may present problems either from a delay standpoint where a small air pump is used to pressurize the tank to the proper pressure or from a cost standpoint when a larger air pump is employed.

SUMMARY OF THE INVENTION

It is an object of the present invention to overcome the drawbacks set forth above. Accordingly, one feature of the present invention is an improved dampening system which continuously supplies dampening fluid through spray nozzles to a rotating cylinder of a printing press by alternating between one of at least two tanks pressurized to a control pressure.

Another feature of the present invention is that when the supply of dampening fluid alternates from one tank to a second tank, the second tank is gradually pressurized to the control pressure so that no significant pressure drop is witnessed by the control pressure. A significant drop in control pressure would affect the flow of fluid to the cylinder.

Yet a further feature of the improved dampening system of the present invention is a pressure control which modulates a source of compressed air to produce a control pressure proportional to the speed of the press. Accordingly, pressurizing a tank to the control pressure proportional to the speed of the press delivers dampening fluid from the tank to the cylinder in proportion to the speed of the press.

Still another feature of the dampening system of the present invention is a simple means to purge the spray nozzles prior to operation of the press.

Toward these ends the improved dampening system for supplying dampening fluid to a rotating cylinder has at least first and second tanks containing a supply of dampening fluid. The first and second tanks, deliver the fluid from the tanks to the rotating cylinder through one or more nozzles. The first or second tank is pressurized to a control pressure from a source of compressed gas, for example air, to cause the fluid to flow from the tanks through the delivery means and to the cylinder. To transfer between the first and second tanks as the source for dampening fluid to the nozzles, means are provided to transfer the control pressure between the first and second tanks. Compressed air from the source of the control pressure is applied through a restriction to gradually pressurize the second tank without significantly receiving the control pressure or the flow of dampening fluid from the first tank.

Additionally, the system includes a purge tank containing a quantity of dampening fluid, the purge tank supplying dampening fluid to the nozzles at an elevated pressure to clear air therefrom.

Accordingly, it is an object of this invention to provide a dampening system which has at least two tanks representing a constant supply of fluid, the tanks being pressurized by a single source of compressed gas to force the fluid to the nozzles. Selection from one tank to another is accomplished without significantly affecting the control pressure thereby maintaining the proper flow of dampening fluid to the cylinder.

It is a further object to set forth a pressure control which modulates a source of compressed air to a control pressure proportional to the speed of the press. The control pressure pressurizes and is transferred between the first and second tanks to constantly force dampening fluid through the nozzles at a flow proportional to the speed of the press.

It is also an object of the present invention to provide a means to purge the nozzles to remove air therefrom. The purge tank effectively and inexpensively accomplishes this purpose.

DESCRIPTION

Figure 1A:
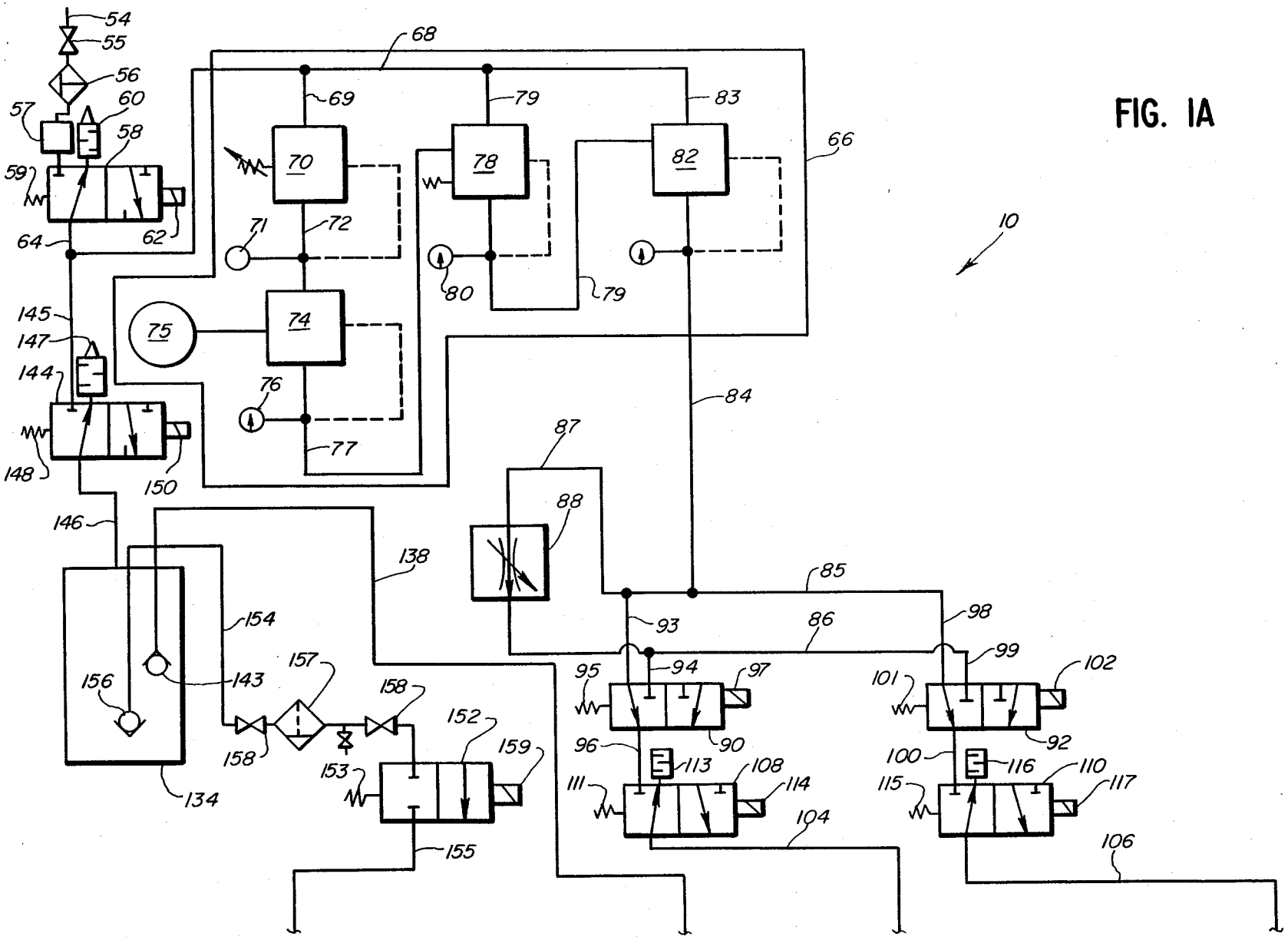
FIGS. 1A and 1B schematically represent the dampening system.
Figure 1B:
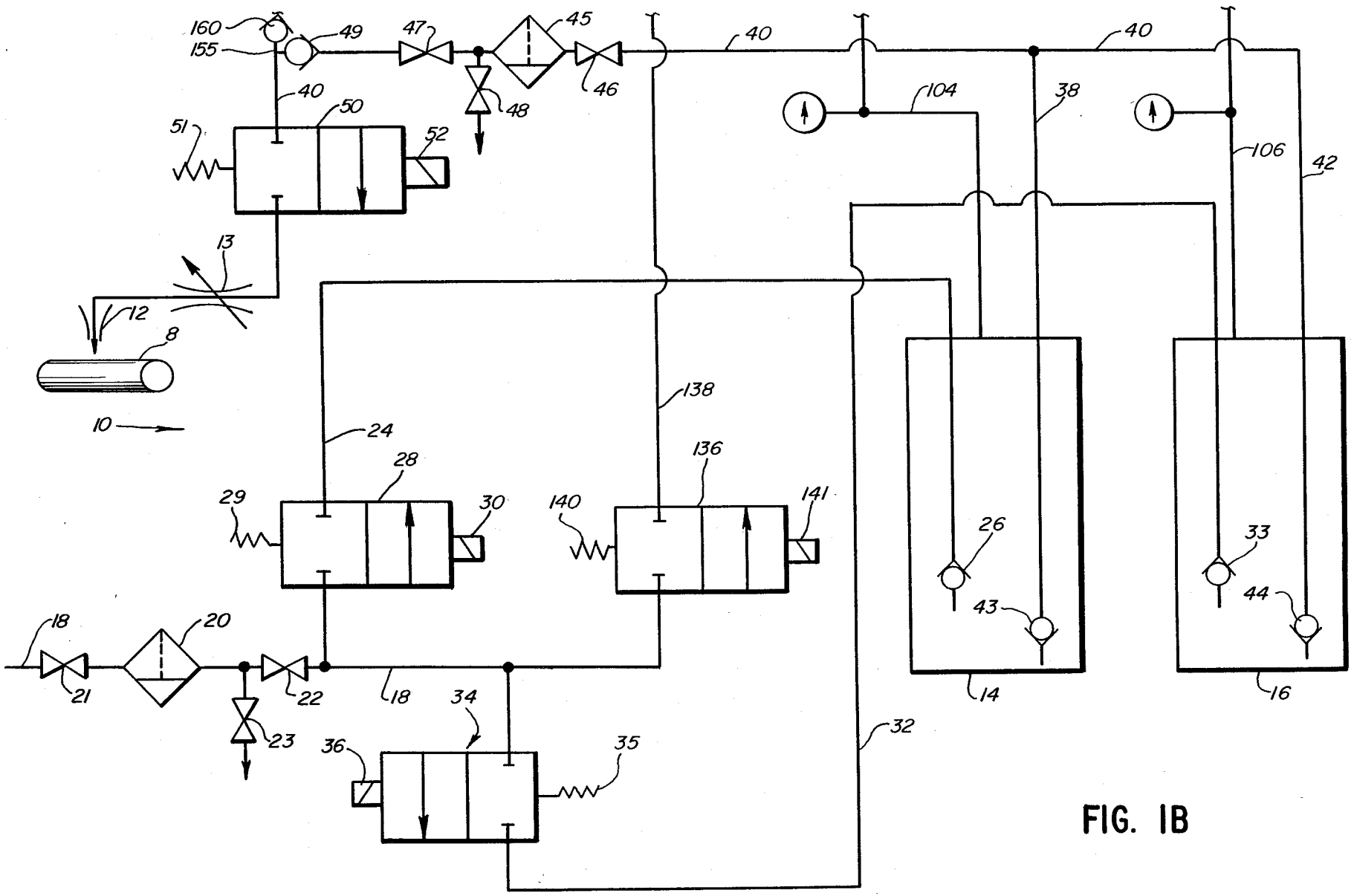

The printing press (not shown) has a rotating cylinder carrying the printing plate (also not shown), the plate cylinder contacting a rotating dampening cylinder 8 which transfers dampening fluid to the plate cylinder. To supply the dampening fluid to the dampening cylinder 8, the system 10 shown in FIGS. 1A and 1B is provided. The system 10 includes at least one nozzle 12 to spray the dampening fluid onto the dampening cylinder 8. A needle valve 13 provides shut-off and manual control for each nozzle 12. Each nozzle 12 is supplied with atomizing air (not shown) to atomize the dampening fluid for proper application of the cylinder 8.

To provide a constant supply of dampening fluid, the system 10 has at least a first and a second tank 14 and 16 respectively. The first and second tanks 14, 16 are closed so that they may be pressurized in the manner described below to supply the dampening fluid contained therein to the nozzle 12.

To fill the first and second tanks 14 and 16, a dampening fluid supply header 18 leading from, for example, a continuously pumped source of dampening fluid is provided as shown in FIG. 1B. The supply header 18 has a filter 20 which may be isolated by isolation valves 21 and 22 for replacement of the filter 20. A drain valve 23 is provided to drain dampening fluid from the header between the isolation valves 21 and 22 when the filter 20 is isolated. Valve 23 is also used to vent air from the housing for filter 20 after filter is replaced. This eliminates problems created by air entering header 18. The venting of air is accomplished by opening valves 21 and 23 while leaving valve 22 closed. A stream of dampening fluid will flow from valve 23 after all air is exhausted. Valve 23 can then be closed and valve 22 opened. Header 18 should be kept pressurized during this operation.

Leading from the supply header 18 to the first tank 14 is a fill line 24. The fill line 24 extends into the first tank 14 terminating at a check valve 26 which prevents fluid from flowing back into the fill line 24 from the first tank 14. Disposed in the fill line 24 is a first fill valve 28. The first fill valve 28 is controlled by a control means, hereinafter described, to deliver dampening fluid from the supply header 18 through fill line 24 to the first tank 14. As seen in FIG. 1B, a spring 29 normally urges the first fill valve 28 to a closed position wherein the fill line 24 is isolated from the supply header 18. When energized by control means, a solenoid 30 displaces the first valve 28 to an open position whereby communication between the supply header 18 and the fill line 24 is accomplished to fill the first tank 14. As described below, during filling the first and second tanks 14 and 16 are vented to atmosphere.

Similar to the first fill line 24, second fill line 32 leads from the supply header 18 to the second tank 16 terminating at a check valve 33. A second fill valve 34 disposed in the second fill line 32 is normally urged to a closed position by a spring 35 to prevent dampening fluid from flowing from the supply header 18 through the second fill line 32 to the second tank 16. When a solenoid 36 is energized by control means, the second valve 34 is displaced to an open position wherein the supply header 18 is placed in communication with the second tank 16 through the second fill line 32 to fill the second tank 16.

Between the first and second tanks 14 and 16 and the nozzle 12, the system 10 includes delivery means. The delivery means include line 38 which supplies dampening fluid from the first tank 14 to a header 40. In a similar manner, line 42 supplies dampening fluid from the second tank 16 to the header 40. Check valves 43 and 44 in lines 38 and 42 respectively prevent dampening fluid from flowing between the first and second tanks 14 and 16 when one of the first and second tanks 14 and 16 is pressurized. The header 40 supplies dampening fluid from the first tank 14 or the second tank 16 to the nozzle 12 which sprays a dampening fluid onto the dampening cylinder 8. Disposed in the header 40 is a filter 45 which may be isolated by isolation valves 46 and 47 and drained by a drain valve 48. The housing for filter 45 is vented as described above for the housing of filter 20. Also disposed in the header 40 is a check valve 49, the purposes of which will hereinafter become evident.

To provide an on-off control of the supply of dampening fluid to the nozzle 12 the system 10 includes a spray valve 50 disposed in header 40. The spray valve 50 is normally urged by a spring 51 to a closed position wherein the nozzle 12 is isolated from the header 40. When spraying of dampening fluid onto the dampening cylinder 8 is required, a solenoid 52 is energized to move the spray valve 50 to an open position wherein dampening fluid is supplied from the header 40 to the nozzle 12.

To pressurize the first and second tanks 14 and 16, compressed air at 100 psig is provided by an air header 54 as shown in FIG. 1A. The air header 54 includes a manual shut-off valve 55 to manually block the flow of compressed air to the system 10 and a filter 56 to remove any particulate matter from the air. Also included in the air header 54 is a controlled air valve 58. When the press is not operating and dampening fluid is not required, the air valve 58 is urged by a spring 59 to a closed position as shown in FIG. 1A wherein the air header 54 is blocked and the system is vented to a muffler 60. When the press is started and dampening fluid is required, a solenoid 62 is energized to move the air valve 58 to an open position wherein the vent 60 is blocked and the air header 54 is placed in communication with system air supply line 64. Pressure regulator 57 reduces the 100 psig air pressure at header 54 to 90 psig at supply line 64.

To control the pressure of the dampening fluid supplied to the nozzle 12 and thereby the quantity of dampening fluid applied to the dampening cylinder 8, the system 10 includes a pressure control 66 supplied by supply line 64 with the aforesaid 90 psig compressed air. The pressure control 66 as shown in FIG. 1A has a supply manifold 68 which, through a line 69, supplies compressed air to a regulator valve 70. The regulator valve 70 reduces the 90 psig air in the manifold 69 to 20 psig. A pressure indicator-controlling instrument 71 provides an indication of the outlet pressure of the regulator valve 70 and a feedback signal to the regulator valve 70 for proper regulation of the outlet pressure of the regulator valve 70.

From the regulator valve 70 the 20 psig air passes through line 72 to a pressure transducing valve 74. The pressure transducing valve 74 receives an electronic control signal from a tachometer 75 which measures the speed of rotation of the plate cylinder (hereinafter referred to as press speed) and supplies a current in proportion to press speed to the transducer valve 74. In response to the signal from the tachometer 75, the transducer valve regulates the 20 psig air pressure to have an output pressure in proportion to press speed. Typically, when the press is not operating and cylinder speed is 0, the output pressure of the transducer valve 74 will accordingly also be 0 psig. At maximum press speed and maximum cylinder rotation, the transducer valve will have an output of 15 psig. A pressure indicating-controlling instrument 76 is provided in line 77 leading from the transducer valve 74 to indicate pressure and provide feedback to the transducer valve 74 for proper modulation of the pressure.

The 0–15 psig outlet pressure of the transducer valve 74, while being in proportion to the press speed, is inadequate to move the dampening fluid at a proper flow rate from the first and second tanks 14 and 16 through the nozzle 12 to the dampening cylinder 8. Accordingly, to boost the output pressure of the transducer valve 74 the pressure control 66 includes a relay valve 78. The relay valve 78 is connected to the manifold 68 by line 79 to have, accordingly, a 90 psig inlet pressure. To control the modulation of the relay valve 78, line 77 representing the outlet pressure of the transducer valve 74, is connected to the relay valve 78 to provide control, or pilot pressure. The pilot pressure provided by line 77 to the relay valve 78 regulates the relay valve 78 to have an outlet pressure proportional to the pilot pressure, and therefore the speed of the press, between 0 and 60 psig. Accordingly, with the cylinder 8 stationary, the relay valve 78 has an output of 0 psig. At maximum press speed the relay valve 78 has an output of 60 psig. A pressure-indicating instrument 80 is disposed in line 79 to indicate pressure and provide feedback to the relay valve 78 for proper modulation thereof.

To further boost the pressure, the pressure control 66 includes booster valve 82 having an inlet represented by line 83 connected to manifold 68 and an outlet shown as line 84. To control the booster valve 82, line 79, the 0–60 psig outlet of the relay valve 72, acts as a pilot to modulate the booster valve 82 to have an outlet pressure 15 psig greater than the outlet pressure of the relay valve 78. Accordingly, line 84 will carry compressed air at pressures between 15 and 75 psig, the pressure varying between these values in proportion to the speed of the press. The pressure determined by the booster valve 82 will hereinafter be referred to as the control pressure.

The control pressure will, as described below, be imposed upon the dampening fluid in the first and second tanks 14 and 16 resulting in the dampening fluid being supplied to the nozzle 12 at a pressure proportional to the speed of the plate cylinder. Since the flow of fluid through the nozzle 12 is dependent upon the pressure differential across the nozzle 12 (i.e., the pressure of the fluid less atmospheric pressure) the flow of fluid through the nozzle 12 to the dampening cylinder 8 will likewise be proportional to the press speed. Accordingly, the object of applying dampening fluid to the dampening cylinder 8 in relation to the speed of the press can be accomplished.

Since, from a cost standpoint, it is advantageous to use a single pressure control 66 for the first and second tanks 14 and 16, means are required to transfer or switch the application of the control pressure, and thereby the supply of dampening fluid, from one tank to the other and vice versa. Furthermore, for constant operation of the press, this selection must be accomplished without a significant drop in pressure of the dampening fluid which would adversely affect the quantity of fluid being applied to the dampening cylinder 8. It may be recalled that the tanks are filled at atmospheric pressure. Therefore, for example, when fluid is being supplied from a near-empty first tank 14, transfer to a full second tank 16 would normally observe a pressure drop until the second tank 16 is fully pressurized to the control pressure.

To transfer between the first and second tanks 14 and 16 without observing the aforementioned pressure drop and the attendant inadequate supply of dampening fluid to the dampening cylinder 8, the system 10 includes a first header 85 connected to line 84 to supply the first and second tanks 14 and 16 with compressed air at the control pressure. Also included is a second header 86 communicating with the first header 85 through a conduit 87 including a flow restricting needle valve 88. Accordingly, as will be fully understood from the following, when the second header 86 is placed in communication with a tank at atmospheric pressure, a small portion of air from the first header 85 will bleed through the restriction of the needle valve 88 to gradually bring the tank up to the control pressure. The gradual pressurization of the tank does not significantly affect the control pressure in the first header 85 and therefore will not adversely affect the flow of dampening fluid in the system 10.

To alternate the supply of dampening fluid to the nozzle 12 from between the first and second tanks 14 and 16 the system 10 includes select valves 90 and 92, each dedicated, respectively, to the first and second tanks 14 and 16. Select valve 90 communicates with the first header 85 via conduit 93 and the second header 86 via conduit 94. In a manner described below, the select valve 90 is controlled between what can be defined as a run position and a pressurizing position.

In the run position, as shown in FIG. 1A, a spring 95 urges the select valve 90 to place conduit 93 in communication with a line 96 and conduit 94 is blocked. In the pressurizing position, a solenoid 97 is energized to displace the select valve 90 against the bias of the spring 95 to a position wherein conduit 93 is blocked and conduit 94 is placed in communication with line 96.

Select valve 92 dedicated to the second tank 16 functions identically to select valve 90 to place either conduit 98, communicating with the first header 85, or conduit 99, communicating with the second header 86, in communication with line 100. Accordingly, a spring 101 normally urges the select valve 92 to the run position (FIG. 1A) and a solenoid 102 positions the select valve 92 to the pressurizing position.

Interposed between lines 96 and 100 and lines 104 and 106 leading, respectively, to the first tank 14 and the second tank 16 are vent valves 108 and 110. Vent valve 108, dedicated to the first tank 14, provides the means to select or transfer the control pressure to or from the first tank 14.

The vent valve 108 is controlled between a closed position as illustrated in FIG. 1A wherein a spring 111 urges the vent valve 108 to a position wherein line 96 is blocked and line 104 leading from the first tank 14 is placed in communication with a muffler 113 to vent the first tank 14 to atmosphere. Vent valve 108 is displaced to an open position by a solenoid 114 against the bias of the spring 111 to block the muffler 113 and place line 96 in communication with line 104 and with the first tank 14. In the open position, control of select valve 90 determines whether the control pressure is imposed upon the dampening fluid in the first tank 14 or whether the pressure in the second header 86 is imposed to gradually pressurize the first tank 14.

In a similar fashion, vent valve 110 is dedicated to the second tank 16 and is urged by a spring 115 to a closed position (FIG. 1A) wherein line 100 is blocked and line 106 leading to the second tank 16 is vented to a muffler 116. A solenoid 117 displaces vent valve 110 against the bias of the spring 115 to an open position wherein the muffler 116 is blocked and line 106 is placed in communication with line 100 to impose the pressure of either the first header 85 (control pressure) or the pressure of the second header upon the dampening fluid in the second tank 16.

Figure 2:
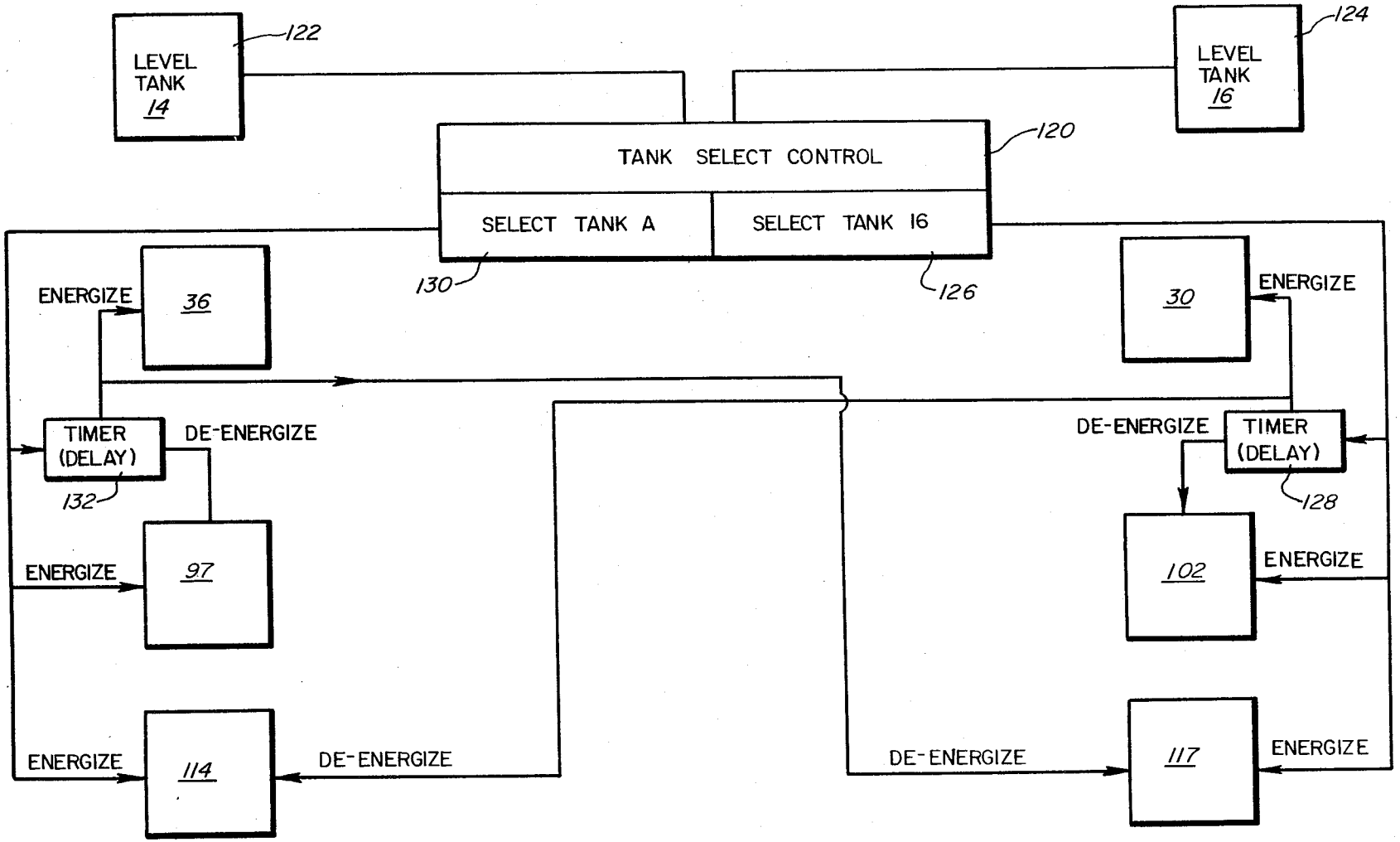
FIG. 2 is a functional block diagram of the control for the dampening system.

To control which of the first tank 14 or second tank 16 is to supply control fluid to the nozzle 12, the select valves 90, 92 and vent valves 108, 110 are controlled as schematically shown in FIG. 2.

To control the aforesaid valves, the system 10 includes a tank select control 120 (FIG. 2). The control 120 receives input as to the levels of the first tank 14 and second tank 16 from level sensors 122 and 124 respectively.

For purposes of further description of the control of the system 10 it shall be assumed that the select valve 90 is at a run position and vent valve 108 is at an open position thereby imposing the control pressure upon the fluid in the first tank 14. Also it shall be assumed that the system 10 is operating and that the spray valve 50 is at an open position whereby the dampening fluid in the first tank 14 flows through line 38, header 40 and nozzle 12 to apply the dampening fluid to the dampening cylinder 8. At the same time select valve 92 is at a run position (FIG. 1A) and the vent valve 110 is at a closed position also as substantially shown in FIG. 1A thereby venting the second tank 16 to the atmosphere. While vented to the atmosphere the second tank 16 may be filled from the supply header 18 as described above.

When the first tank level sensor 122 senses a low level in the first tank 14, a signal activates a tank 16 select sequence diagrammatically shown in FIG. 2 as a select tank 16 sequence control 126. Sequence control 126 at the same time energizes solenoids 102 and 117 to respectively position select valve 92 at the pressurizing position and the vent valve 110 at the open position. Accordingly, the second header 86 is placed in communication with the second tank 16 through lines 99, 100 and 106. This results in control pressure air bleeding through needle valve 88 to gradually pressurize the second tank 16 to the control pressure without substantially affecting the control pressure in the first header 85 and first tank 14 or the resultant flow of dampening fluid through the nozzle 12. At the same time solenoids 102 and 117 are energized, a delay timer 128 is activated. The timer 128 is adapted to measure a period of time sufficient for the air flowing through the needle valve 88 and second header 86 to pressurize the second tank 16 to the control pressure. At the expiration of the aforementioned period of time, solenoid 114 is de-energized to move vent valve 108 to a closed position to vent the first tank 14 and solenoid 102 de-energized whereupon select valve 92 is urged to the run position by the spring 101 such that the control pressure communicates with the second tank 16 from the first header 85. Additionally, the solenoid 30 of the first fill valve 28 may be energized to begin to refill the first tank 14. When the first tank 14 has been filled, level sensor 122 signals control 20 that the first tank 14 is ready for use and de-energizes solenoid 30 whereupon the first fuel valve 28 closes to stop the filling of the first tank 14. Additionally timer 128 is re-set.

When level sensor 124 senses low level of the second tank 16, a signal through the control 120 initiates a select tank 14 sequence control 130. In a manner similar to that described above, the sequence control energizes solenoids 97 and 114 to place the second header 86 in communication with the first tank 14. Accordingly, the first tank 14 is pressurized without significantly affecting the control pressure and thereby the flow of control fluid from the second tank 16 to the nozzle 12. At the same time, timer 132 is activated to measure the period of time sufficient for the first tank 14 to be pressurized to the control pressure period. At the expiration of the aforesaid period of time, solenoid 97 is de-energized to position the select valve 97 at the run position and solenoid 117 is de-energized to close vent valve 110. Accordingly, the control pressure is imposed upon the dampening fluid in the first tank 14 to supply the dampening fluid to the nozzle 12 for application to the dampening cylinder 8. Solenoid 36 may also be energized for filling of the second tank 16.

As can be appreciated from the above, the gradual pressurization of the tanks prior to selection by the control 20 does not significantly affect the control pressure thereby enabling the system 10 to provide a continuous, correct quantity of dampening fluid to the nozzle 12 for application to the dampening cylinder 8.

To purge air from the nozzles 12 and associated piping before operation of the press, the system 10 includes a purge tank 134 as shown in FIG. 1A. The purge tank 134 is filled from the supply header 18 with dampening fluid by operation of a third fill valve 136. In a manner similar to that of the first and second fill valves 28, 34, the third fill valve 136 is disposed in a fill line 138 and is controlled for movement between a closed and open position. In the closed position, a spring 140 urges the valve to block fill line 138. To open the third fill valve 136 for filling of the purge tank 134, a solenoid 141 is energized by a float switch (not shown) located inside tank 134 to move the third fill valve 136 to an open position wherein dampening fluid from the supply header 18 flows through fill line 138 into the purge tank 134. A check valve 143 at the purge tank 134 prevents dampening fluid from back flowing into the fill line 138 and supply header 18.

To move the dampening fluid from the purge tank 134 for purging of the nozzle 12, the system 10 includes an air valve 144 movable between an open and closed position. In the closed position, as shown in FIG. 1A, the air valve 144 blocks line 145 extending from supply line 64 and places line 146 connected to the purge tank 134 in communication with a muffler 147 to vent the purge tank 134 to atmosphere. A spring 148 normally urges the air valve 144 to the aforesaid closed position. To pressurize the purge tank 134, a solenoid 150 is energized from, for example, a main control panel to displace the air valve 144 against the bias of the spring 148 to an open position. In the open position muffler 147 is blocked and line 145 and line 146 are placed in communication to admit compressed air in the supply line 64 into the purge tank 134 to pressurize the purge tank 134 and the dampening fluid contained therein to the supply line pressure of 90 psig.

To accomplish the purging of the nozzle 12, a purge valve 152 movable between a closed and open position is provided. In the closed position, as shown in FIG. 1A, a spring 153 urges the purge valve 152 to block line 154 leading from the purge tank 134 and line 155 extending from the purge valve 152 to the header 40. A check valve 160 is provided at the purge tank 134 in line 155 to prevent dampening fluid from backflowing into the purge tank 134. Additionally, line 154 has a filter 157 which may be isolated by isolation valves 158. When purging is required, a solenoid 159 is energized from, for example, a main control panel to displace the purge valve 152 to an open position wherein dampening fluid in the purge tank pressurized by the air pressure of the supply line 64 flows through lines 154, 155 to the header 40 and through an open spray valve 50 to the nozzle 12. Accordingly, dampening fluid at approximately 90 psig is provided to purge air from the nozzle 12. Check valves 160 and 49 are disposed, respectively, in line 155 and header 40 to prevent the dampening fluid from the purge tank 134 from backflowing into the header 40 to the first and second tanks 14, 16 or dampening fuid in the header from flowing to the purge tank 134.

While I have shown and described certain embodiments of the present invention, it is to be understood that it is subject to many modifications without departing from the spirit and scope of the claims hereinafter set forth. For example, the solenoid control valves described with respect to the system could be replaced with pneumatically controlled valves adapted to accomplish the aforesaid functions.

I claim:

1. A system for supplying dampening fluid to a rotating cylinder of a printing press, comprising:

two dampening solution tanks;

means for delivering dampening solution to said cylinder alternately from each of said tanks;

a source of dampening solution;

means connecting said source of dampening solution alternately with each of said tanks for filling an empty tank while dampening solution is delivered to the cylinder from the other tank; and means to sense the level of the one dampening solution tank delivering dampening fluid to the cylinder, said level sensing means at a low level activating a control means to alternate the delivery of dampening fluid to the cylinder from the other tank.

2. The system of claim 1 wherein said control means when activated controls the connecting means to connect said source of dampening fluid to said one tank to fill said one tank.

3. The system of claim 3 wherein said level sensing means of said one tank activates said control means when said one tank is filled to control said connecting means to disconnect said source of dampening from said one tank and stop filling thereof.

4. A system for supplying dampening fluid to a rotating cylinder printing press, comprising:

two dampening solution tanks;

means for deliverying dampening solution to said cylinder alternately from each of said tanks, including a source of compressed air connectable with each tank for forcing dampening solution from the tank to the cylinder; and means for transferring delivery from one tank to the other, including means connecting the other tank with said source of compressed air through an orifice to increase the pressure in the other tank gradually without reducing the pressure of said source.

5. The system of claim 4 wherein said transferring means when activated controls said connecting means to connect said other tank with said source of compressed air through an orifice to gradually pressurize said other tank for a period of time to the pressure of said source, the transferring means transferring delivery of dampening fluid to said other tank at the expiration of said period of time.

6. The system of claim 4 further including means to sense the level of each tank, said level sensing means activating control means when said one tank is at a low level to control said transferring means and transfer delivery from one tank to the other tank.

7. A system for supplying dampening fluid to a rotating cylinder for a printing press, comprising:

a tank of dampening fluid;

means to deliver fluid from said tank to said cylinder;

a source of unregulated air pressure;

a pressure reducing regulator valve connected with said source of unregulated air pressure;

a tachometer connected with the cylinder of said press;

a pressure transducing valve having an air input connected with the output of said regulator valve and a control input connected with said tachometer, said pressure transducing valve having an air pressure output related to the speed of said press;

a booster valve having an input connected with said unregulated pressure source and a control input connected with the output of said tranducing valve, said booster valve having a control pressure output connected with said tank, whereby dampening fluid is delivered to said cylinder at a rate related to the cylinder speed.

8. The system of claim 7 further including another tank of dampening fluid and means for transferring said delivery means from said tank to said another tank, including means disconnecting said control pressure from tank and connecting said control pressure to said another tank.

9. The system of claim 8 further including means to pressurize said another tank gradually with said control pressure through an orifice without reducing said control pressure.

10. A system for supplying dampening fluid to a rotating cylinder of a printing press comprising:

closed first and second tanks containing dampening fluid;

means to deliver said fluid from said tanks to said cylinder;

means for supplying compressed air at a control pressure, said control pressure initially supplied to said first tank to cause dampening fluid at substantially said control pressure to flow from said first tank to said delivery means to the cylinder; and means to transfer said control pressure from communicating with said first tank to communicating with said second tank, said transfer means including means to pressurize said second tank by supplying compressed air at said control pressure through a restriction to said second tank for a period of time to pressurize said second tank to said control pressure, at the expiration of said period of time, said transfer means transferring said control pressure from said first tank to said second tank to cause dampening fluid to flow from said second tank through said delivery means to the cylinder whereby a constant supply of dampening fluid at substantially set control pressure is delivered to said cylinder.

11. The system of claim 10 wherein said select means includes a select valve for said second tank, said select valve controlled between a pressurizing position wherein said pressurizing means communicates with said second tank and a run position wherein said control pressure communicates with said second tank to cause said dampening fluid to be delivered from said second tank to said cylinder.

12. The system of claim 11 wherein said select means further includes a vent valve for said first tank, said vent valve controlled to block said control pressure to said first tank when said select valve is controlled to a run position.

13. The system of claim 10 wherein said select means includes a select valve and a vent valve for each of said tanks, said select valves controlled between a pressurizing position for providing communication between said pressurizing means and said tanks to a run position wherein said select valves communicate said control pressure to said tanks and said vent valves are controlled between an open position wherein said pressurizing means and said control pressure communicate with said tank and a closed position to block communication by said pressurizing means and said control pressure, said system further including control means to control said select valve for said second tank to a pressurizing position and said vent valve for said second tank to an open position wherein said pressurizing means pressurizes said second tank, at the expiration of said period of time, said control means controlling said select valve for said second tank to a run position to admit said control pressure to said second tank and controlling said vent valve for said first tank to a closed position to isolate said first tank from said pressurizing means and control pressure.

14. The system of claim 10 wherein compressed air is provided at a constant pressure, said system further including means to modulate said compressed air to said control pressure proportional to the speed of the press, said control pressure when applied to said tanks providing dampening fluid through said delivery means to said rotating cylinder proportional to the speed of the press.

15. The system of claim 14 wherein said modulating means includes means to sense the speed of the press, said speed sensing means generating a signal proportional to the speed of the press and a transducer valve controlled by said signal to modulate said compressed air to said control pressure.

16. The system of claim 15 wherein said transducer valve controls said compressed air to a pressure proportional to the speed of the press, the system further including means for boosting proportional pressure to a pressure defining said control pressure.

17. A system for supplying dampening fluid to a rotating cylinder of a printing press comprising:

closed first and second tanks to supply dampening fluid to said cylinder;

means to deliver said fluid from said tanks to said cylinder, said delivering means including at least one nozzle to spray said fluid onto said cylinder;

compressed air at a control pressure proportional to the speed of the press, said control pressure communicating with said first tank to force said dampening fluid therefrom through said delivery means to said cylinder at a flow rate proportional to the speed of the press; and means to select said supply of dampening fluid from said first tank to said second tank, said select means including means to pressurize said second tank by bleeding compressed air at said control pressure through a restriction to said second tank for a period of time to pressurize said second tank to said control pressure, at the expiration of said period of time, said select means transferring said control pressure from said first tank to said second tank to force dampening fluid to flow from said second tank through said delivery means to said cylinder.

* * * * *